US011517156B2

(12) United States Patent
Leavitt et al.

(10) Patent No.: US 11,517,156 B2
(45) Date of Patent: Dec. 6, 2022

(54) WALK-IN BATH

(71) Applicant: Safety Tubs Company, LLC, Grand Prairie, TX (US)

(72) Inventors: Douglas Leavitt, Bethlehem, PA (US); Christopher Helmstetter, Langhorne, PA (US)

(73) Assignee: Safety Tubs Company, LLC, Grand Prairie, TX (US)

( * ) Notice: Subject to any disclaimer, the term of this patent is extended or adjusted under 35 U.S.C. 154(b) by 0 days.

(21) Appl. No.: 17/277,217

(22) PCT Filed: Sep. 19, 2019

(86) PCT No.: PCT/US2019/051822

§ 371 (c)(1),
(2) Date: Mar. 17, 2021

(87) PCT Pub. No.: WO2020/061246

PCT Pub. Date: Mar. 26, 2020

(65) Prior Publication Data

US 2022/0022700 A1 Jan. 27, 2022

Related U.S. Application Data

(60) Provisional application No. 62/733,909, filed on Sep. 20, 2018.

(51) Int. Cl.
*A47K 3/00* (2006.01)
*A47K 3/022* (2006.01)

(52) U.S. Cl.
CPC ..... *A47K 3/006* (2013.01); *A47K 3/022* (2013.01)

(58) Field of Classification Search
CPC .. A47K 3/12–125; A47K 3/022; A47K 3/006; A47K 17/022–026
See application file for complete search history.

(56) References Cited

U.S. PATENT DOCUMENTS 3,066,316 A * 12/1962 Russell ..... A47K 3/006 4/556
3,719,960 A * 3/1973 Russell ..... A47K 3/006 4/590

(Continued)

FOREIGN PATENT DOCUMENTS

FR 2953705 A1 6/2011
GB 2352393 * 1/2001 ..... A47K 3/00
WO WO2011110313 * 9/2011 ..... A47K 3/00

OTHER PUBLICATIONS

International Search Report dated Dec. 4, 2019 in corresponding International Application No. PCT/US2019/051822 (2 pages).

(Continued)

*Primary Examiner* — David P Angwin
*Assistant Examiner* — Nicholas A Ros
(74) *Attorney, Agent, or Firm* — Tyler A. Stevenson; Anna-lisa L. Gallo

(57) ABSTRACT

A walk-in bath comprising a sidewall and a door; wherein the door is configured to be in an open position or a closed position, the sidewall and closed door define a tub configured to hold bathing water, the door comprises a fin configured to be grasped by a bather, and the fin comprises a continuous projection positioned on a top edge of the door between a first end of the door and a second end of the door.

20 Claims, 11 Drawing Sheets

(56) References Cited

U.S. PATENT DOCUMENTS

| | | | | |
|---|---|---|---|---|
| 3,863,275 | A * | 2/1975 | Brendgord | A47K 3/022 4/569 |
| 4,346,485 | A * | 8/1982 | Reed | A47K 3/022 4/601 |
| D270,658 | S * | 9/1983 | Sills | D23/277 |
| 8,307,471 | B2 * | 11/2012 | Seymour | A47K 3/006 4/578.1 |
| 2005/0044620 | A1 * | 3/2005 | Metcalf | A47K 3/006 4/556 |
| 2010/0156120 | A1 | 6/2010 | Luo | |
| 2010/0275364 | A1 | 11/2010 | Torres et al. | |
| 2011/0056013 | A1 | 3/2011 | Seymour et al. | |
| 2012/0192350 | A1 * | 8/2012 | Stafford | A47K 3/006 4/556 |
| 2012/0304376 | A1 | 12/2012 | Neidich et al. | |
| 2014/0201900 | A1 | 7/2014 | Torres | |
| 2018/0192829 | A1 * | 7/2018 | Manchiraju | A61H 33/6005 |

OTHER PUBLICATIONS

European Patent Application No. 19863805.8 Supplementary European search report dated May 30, 2022.

* cited by examiner

WALK-IN BATH

The present invention relates to a walk-in bath and, in some embodiments, to a door for a walk-in bath.

BACKGROUND

Existing walk-in baths and/or doors for walk-in baths may be manufactured using vacuum forming or by assembling fiberglass reinforced polymer panels (FRP panels) together. Other existing walk-in baths and/or doors for walk-in baths may be manufactured by spraying a coating (e.g., gel coating) into a mold and then applying a fiberglass mat or fiberglass and resin mixture to the coating.

Doors for walk-in baths are opened and closed many times during their lifetime. A door for a walk-in bath must hold a water-tight seal throughout the bath's lifetime. Desired are walk-in baths comprising doors that provide for a water-tight seal over the lifetime of a walk-in bath.

SUMMARY

Accordingly, disclosed is a walk-in bath comprising a sidewall and a door; wherein the door is configured to be in an open position or a closed position, the sidewall and closed door define a tub configured to hold bathing water, the door comprises a fin configured to be grasped by a bather, and the fin comprises a continuous projection positioned on a top edge of the door between a first end of the door and a second end of the door.

Also disclosed is a door for a walk-in bath, the door comprising an angled edge surface of from about 39 degrees to about 49 degrees. In some embodiments, the door angled edge surface comprises a channel configured to receive a gasket.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

In some embodiments, the present disclosure describes a door for a walk-in bath that is manufactured via an injection process, such as injection molding. The method of manufacturing a door may be selected to allow for tighter tolerances and/or more detailed internal features than traditional manufacturing methods. The time, material, and/or labor necessary to manufacture the door by injection molding may be less than traditional manufacturing methods. In some embodiments, the door may include internal reinforcing ribs. A door may comprise a plurality of pieces that are joined together. A door may be lighter in weight than existing doors. A door may be manufactured such that the door is lighter than existing doors without loss in thermodynamic performance compared to existing doors. A door may be manufactured to reduce the number of anchors (e.g., threaded connectors, rivets) used to couple the door to other components compared to existing manufacturing methods. Some components (e.g., a strike plate, a hinge) may be molded into the door. A door may include a fin on a top end thereof, which fin may be engageable by a user (a bather) to provide a handrail. The fin may be part of a ridge that extends around a portion of the perimeter of a tub.

Figure 1:
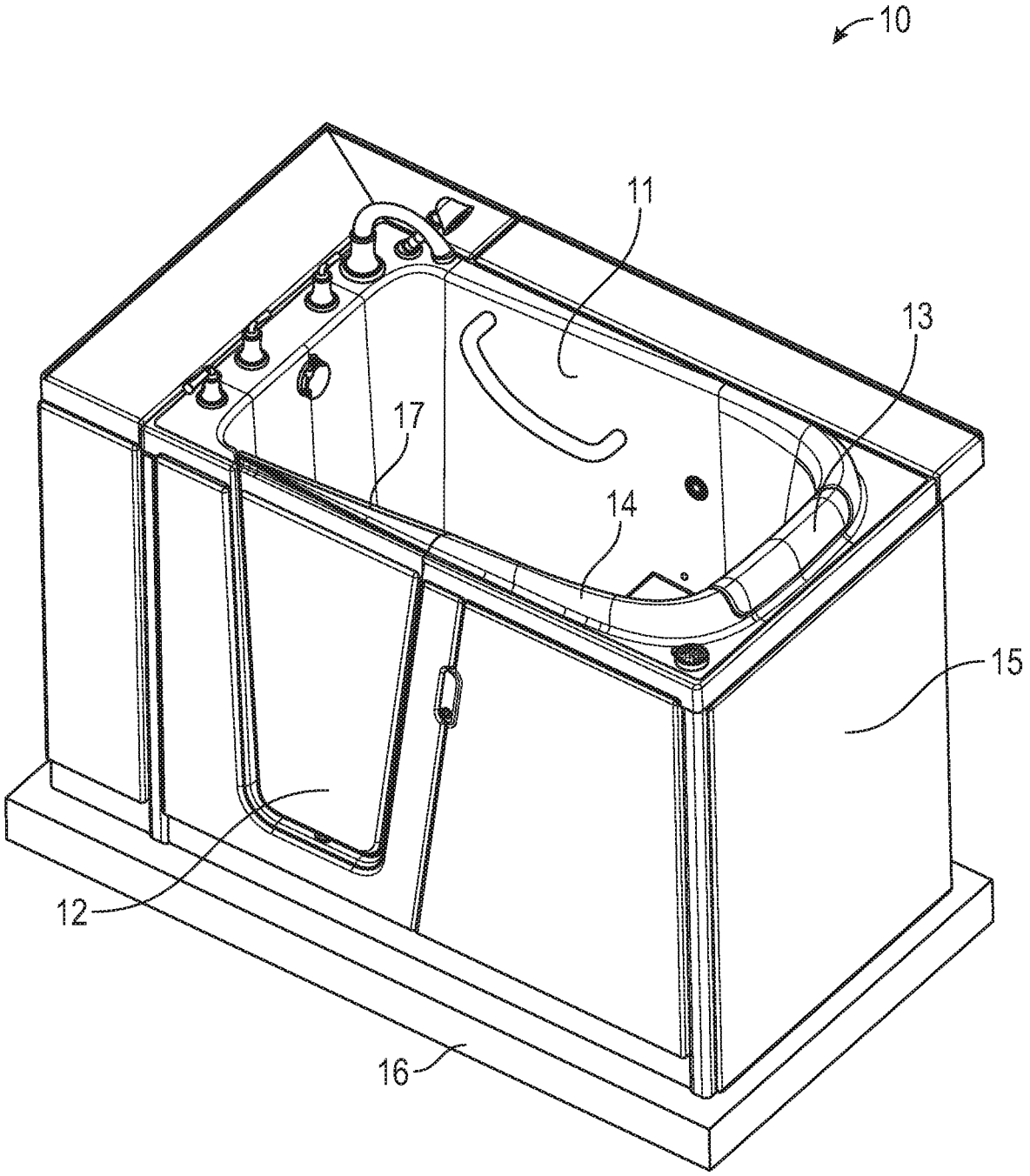
FIG. 1 is a perspective view of a walk-in bath in accordance with an exemplary embodiment.
Figure 2:
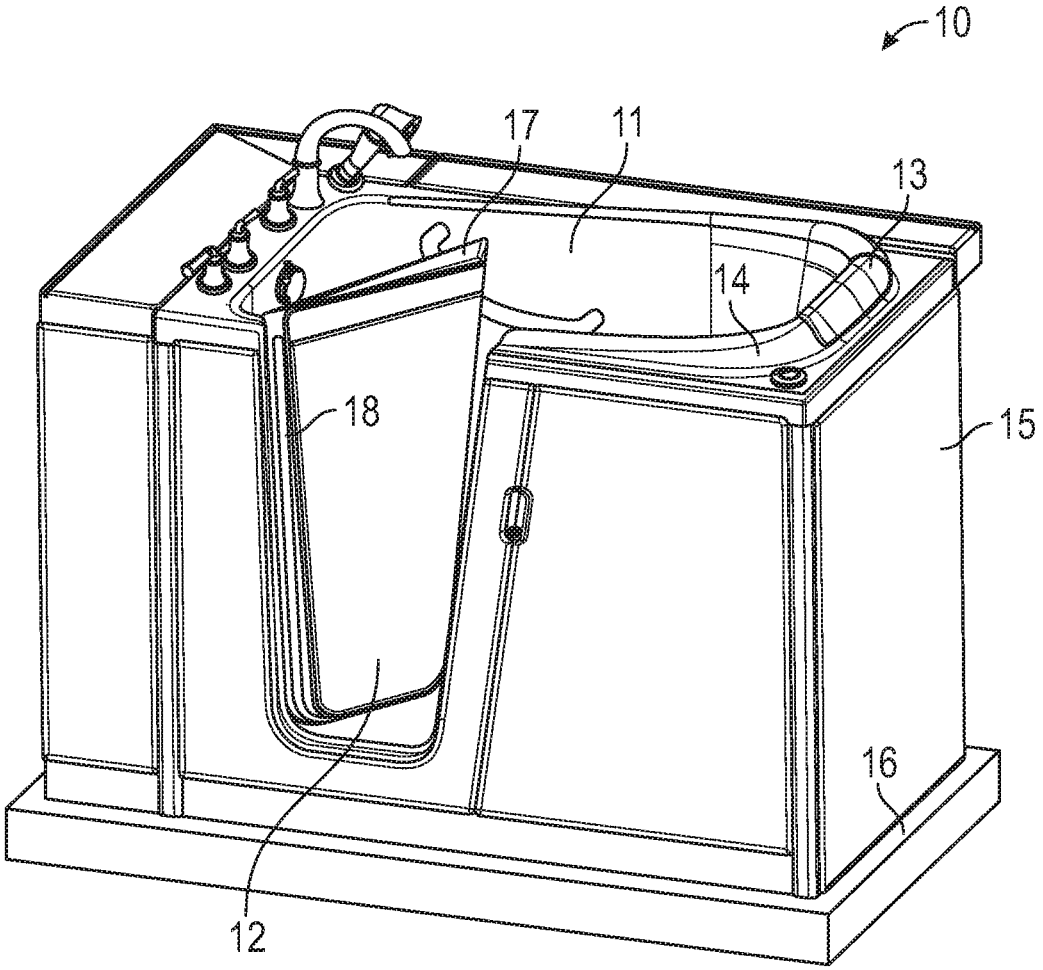
FIG. 2 is a perspective view of a walk-in bath, according to an embodiment.

FIG. 1 and FIG. 2 show a walk-in bath 10, according to an embodiment, with door 12 in a closed and open position, respectively. Walk-in bath 10 includes sidewall 11. Sidewall 11 and closed door 12 define a tub configured to contain water for a user (bather) to bathe in. Headrest 13 is part of ridge 14 which extends around a portion of an upper edge of sidewall 11. One or more panels 15 are supported by base 16. Fin 17 forms a continuous surface with ridge 14 with door 12 in a closed position. Gasket 18 on door 12 is visible in FIG. 2.

Figure 3:
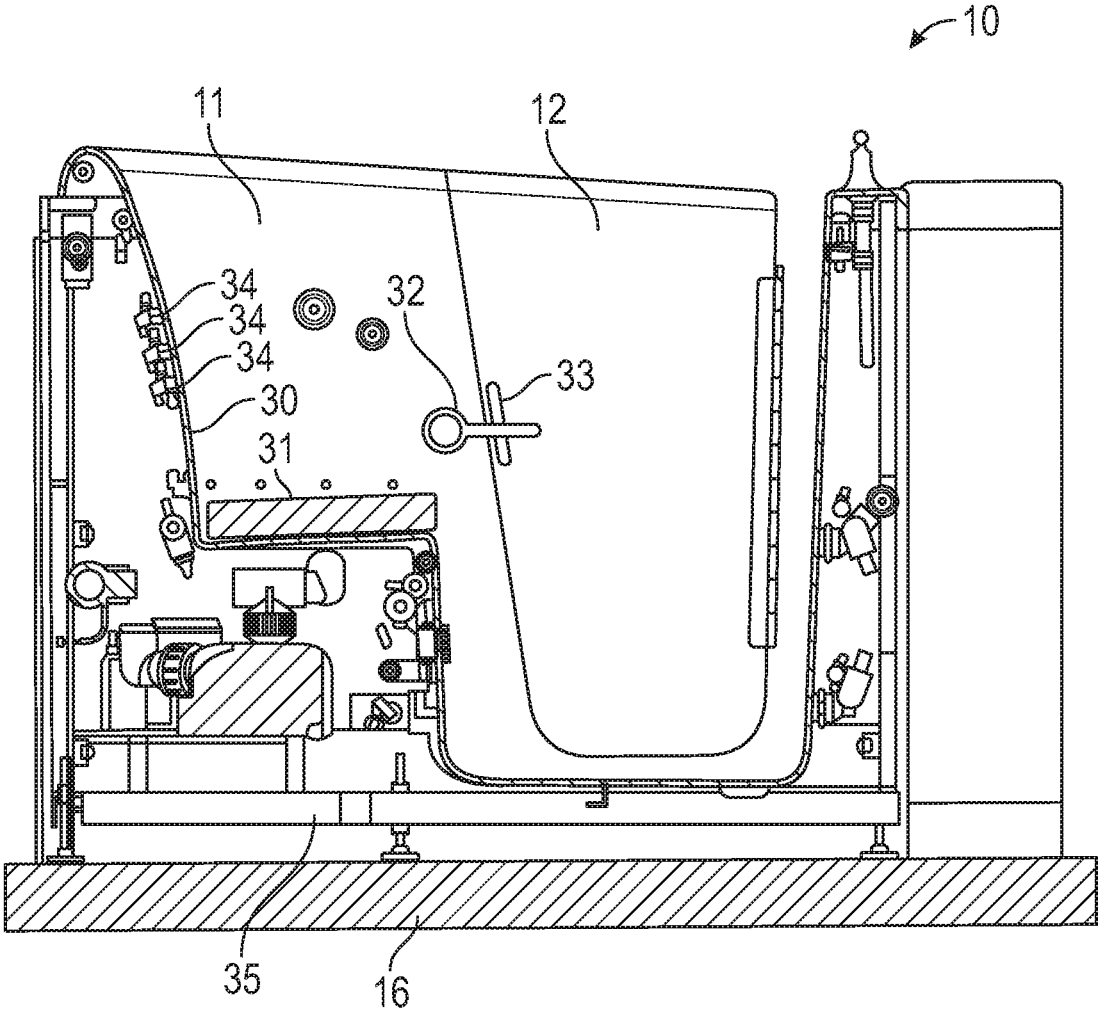
FIG. 3 is a sectional view of a walk-in bath, according to an embodiment.
Figure 4:
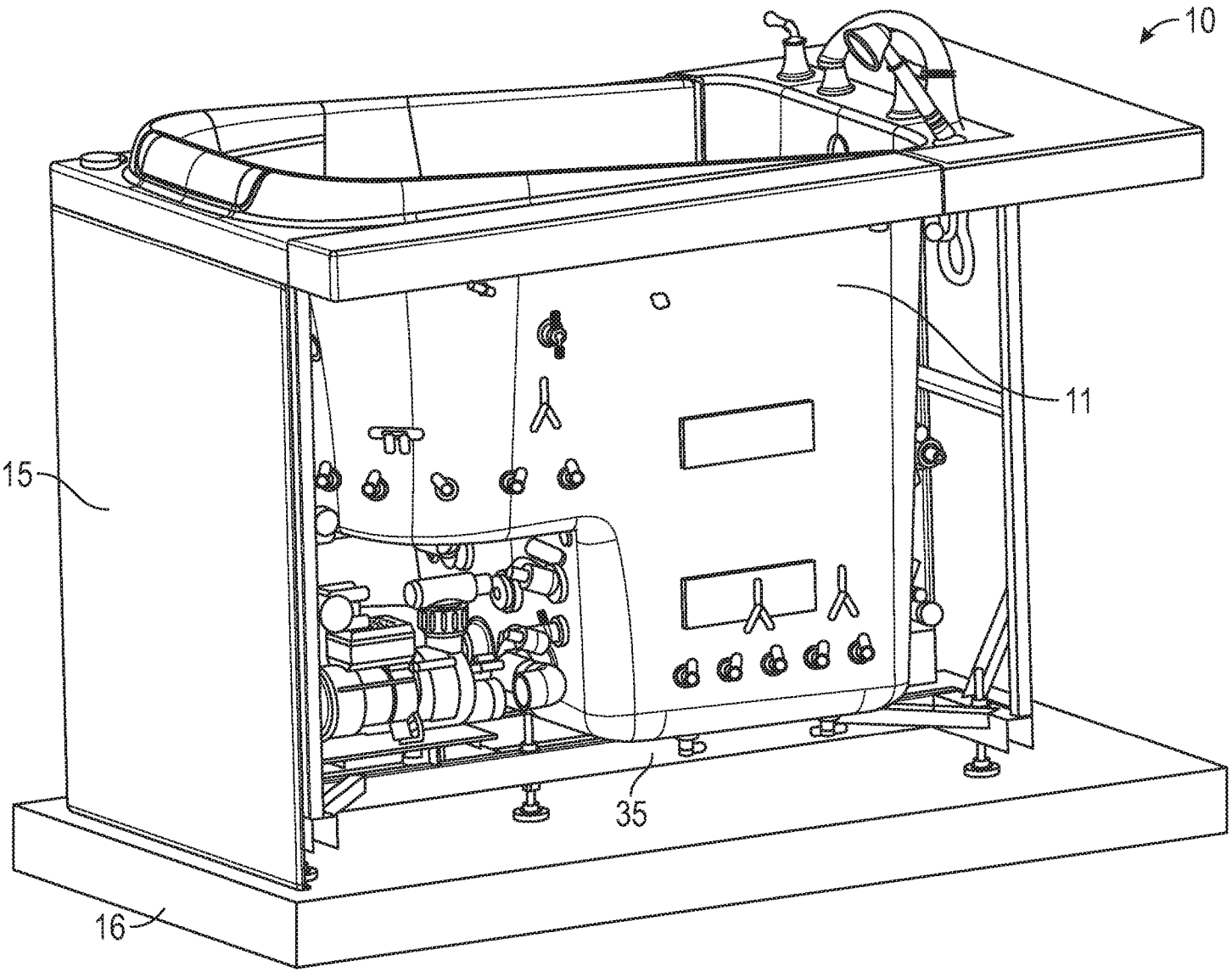
FIG. 4 is a perspective view of a walk-in bath, according to an embodiment.

FIG. 3 provides a sectional view of walk-in bath 10, according to an embodiment. Door 12 is in a closed position. Visible are seat 30 and seat cushion 31. Also visible are handle 32 and strike plate 33. Jet nozzles 34 and a portion of frame 35 are seen. FIG. 4 provides a view of walk-in bath 10 with a panel 15 removed. Visible is a portion of frame 35. Frame 35 supports sidewall 11. Panels 15 are coupled to frame 35. Frame 35 is coupled to base 16.

Figure 5:
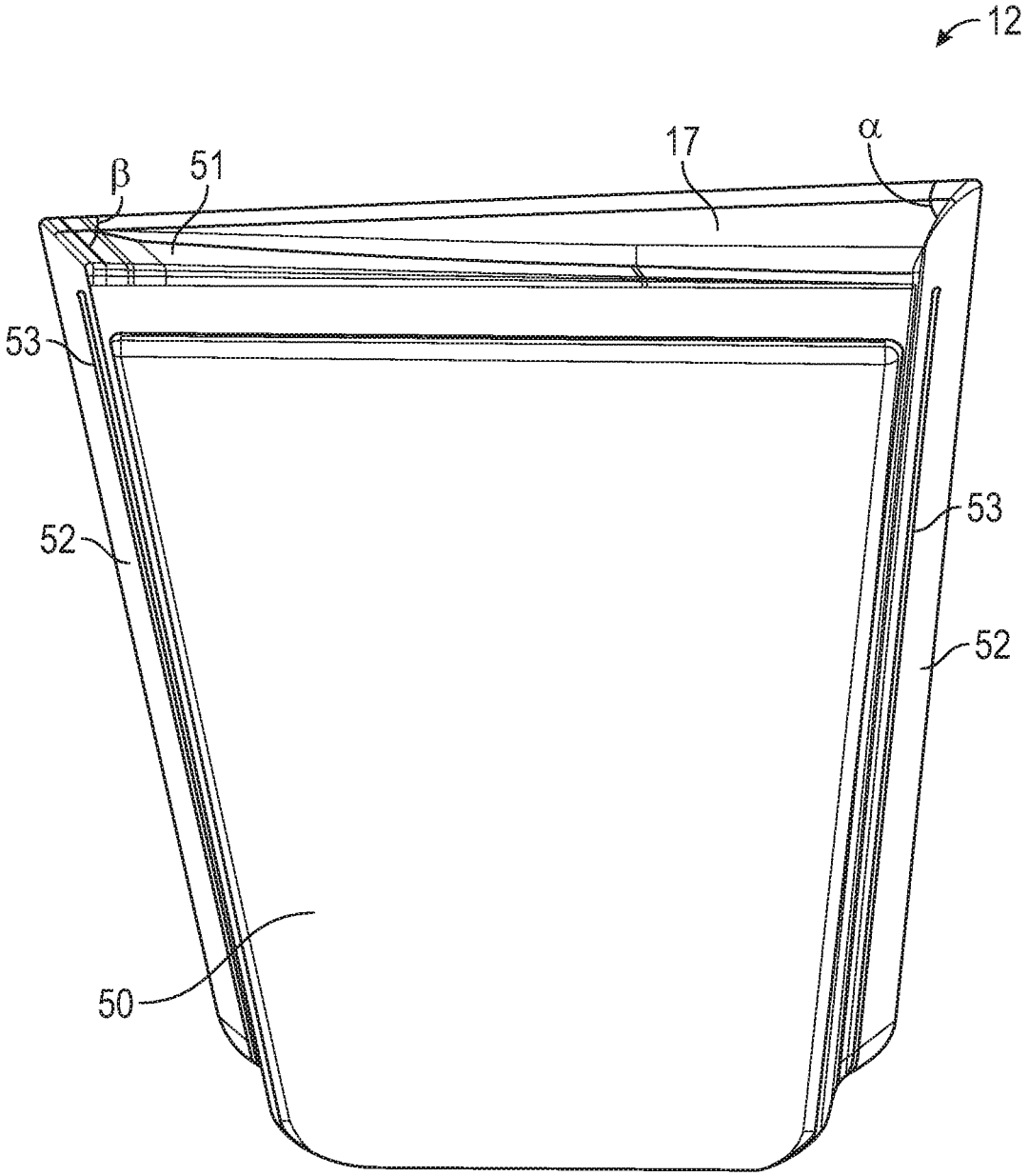
FIG. 5 is a top perspective view of a door of a walk-in bath, according to an embodiment.
Figure 6:
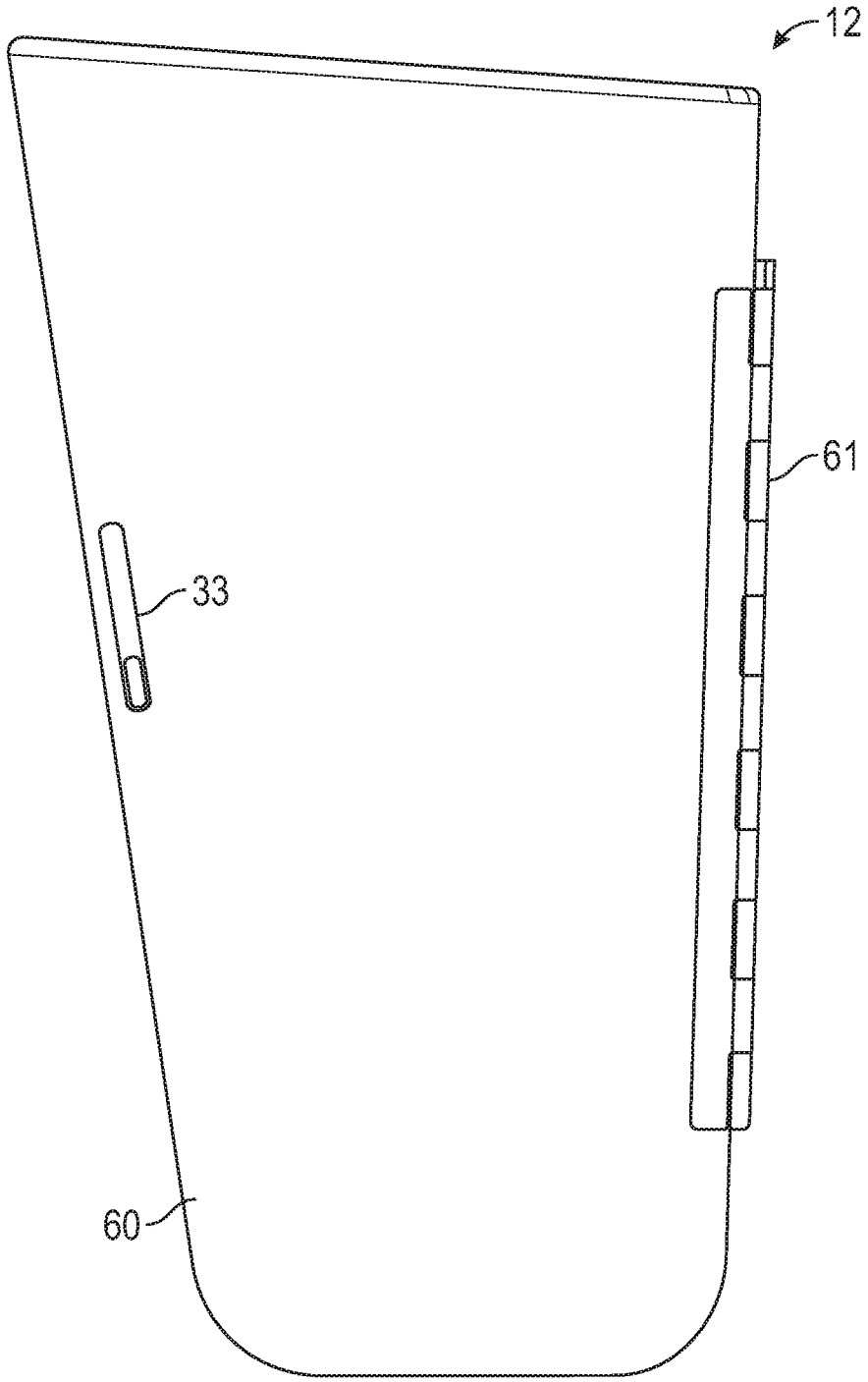
FIG. 6 is a view of a door for a walk-in bath, according to an embodiment.

FIG. 5 provides a view of a door 12 for a walk-in bath, according to an embodiment. Door 12 comprises fin 17 extending from an upper surface 51 thereof. Door 12 comprises outer surface 50 (door face) configured to be aligned and coplanar with an outer surface of a walk-in bath when the door is in a closed position. Also shown is angled edge surface 52 extending around door 12 and configured to engage an inner surface of a walk-in bath sidewall. In this embodiment, angles $\alpha$ and $\beta$ are each about 43 degrees. Angled edge surface 52 comprises channel 53 configured to receive a gasket. A door bottom edge surface (not visible) is also angled about 43 degrees. FIG. 6 shows a view of a door 12 having an inner surface 60, strike plate 33 and hinge 61 (piano hinge).

Figure 7:
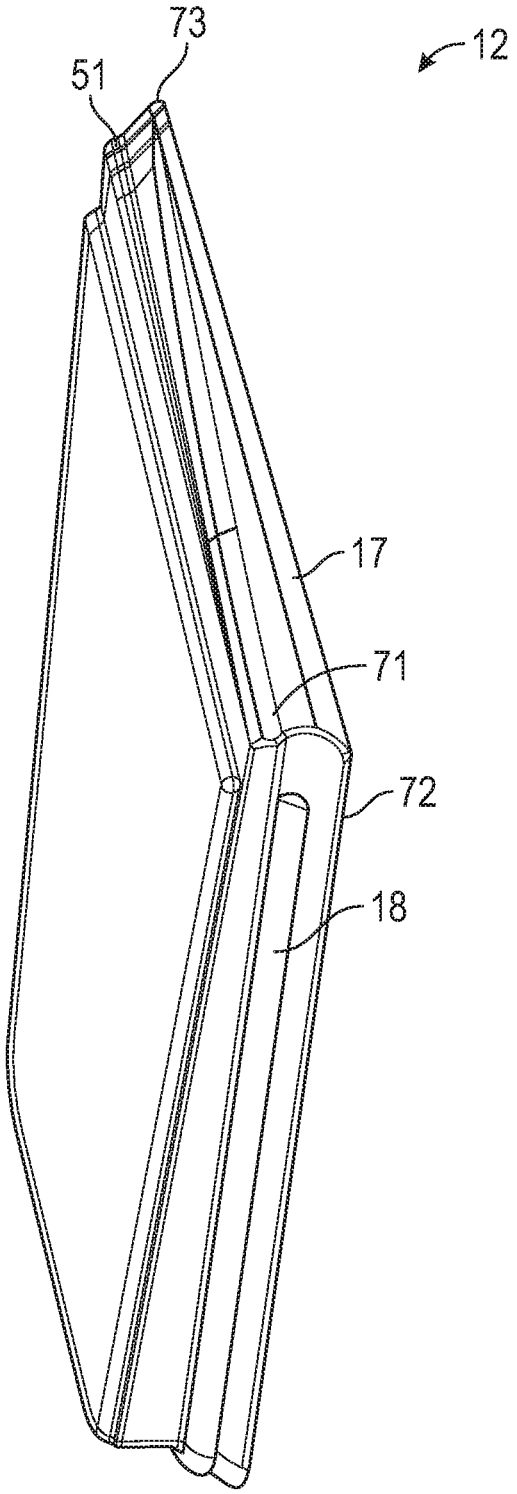
FIG. 7 is a side view of a door of a walk-in bath, according to an embodiment.

FIG. 7 provides a side view of a door 12, according to an embodiment. Fin 17 extends from upper surface 51 of door 12. Fin 17 comprises concave portion 71. Fin 17 has a maximum width at door first end 72 and a minimum width at door second end 73. Fin 17 tapers from a maximum height at door first end 72 to a minimum height at door second end 73.

Figure 8:
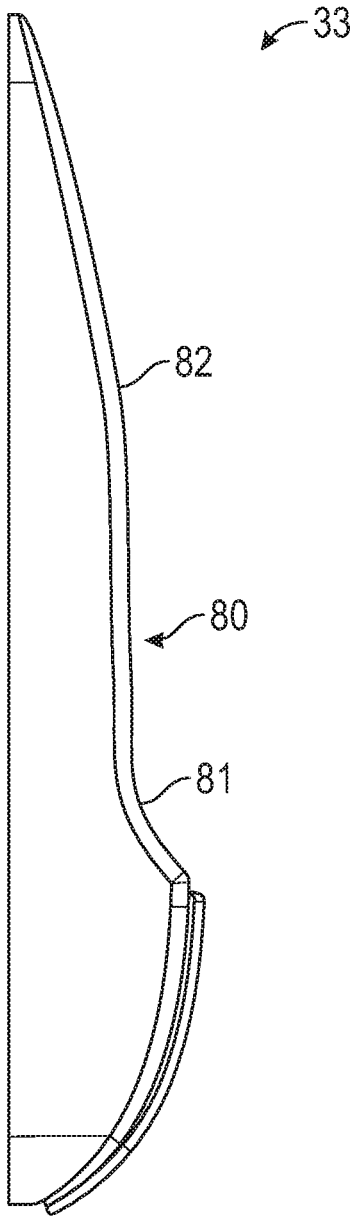
FIG. 8 is a side view of a strike plate of a door of a walk-in bath, according to an embodiment.

FIG. 8 shows a strike plate 33, according to an embodiment. Strike plate 33 is configured to engage a handle 32 (FIG. 3) of a walk-in bath to maintain a door in a closed position. Strike plate 33 comprises engagement surface 80 such that as handle 32 moves relative to the strike plate, door 12 is moved into a fully closed position. Surface 80 comprises a convex section 82 above a concave section 81.

Figure 9:
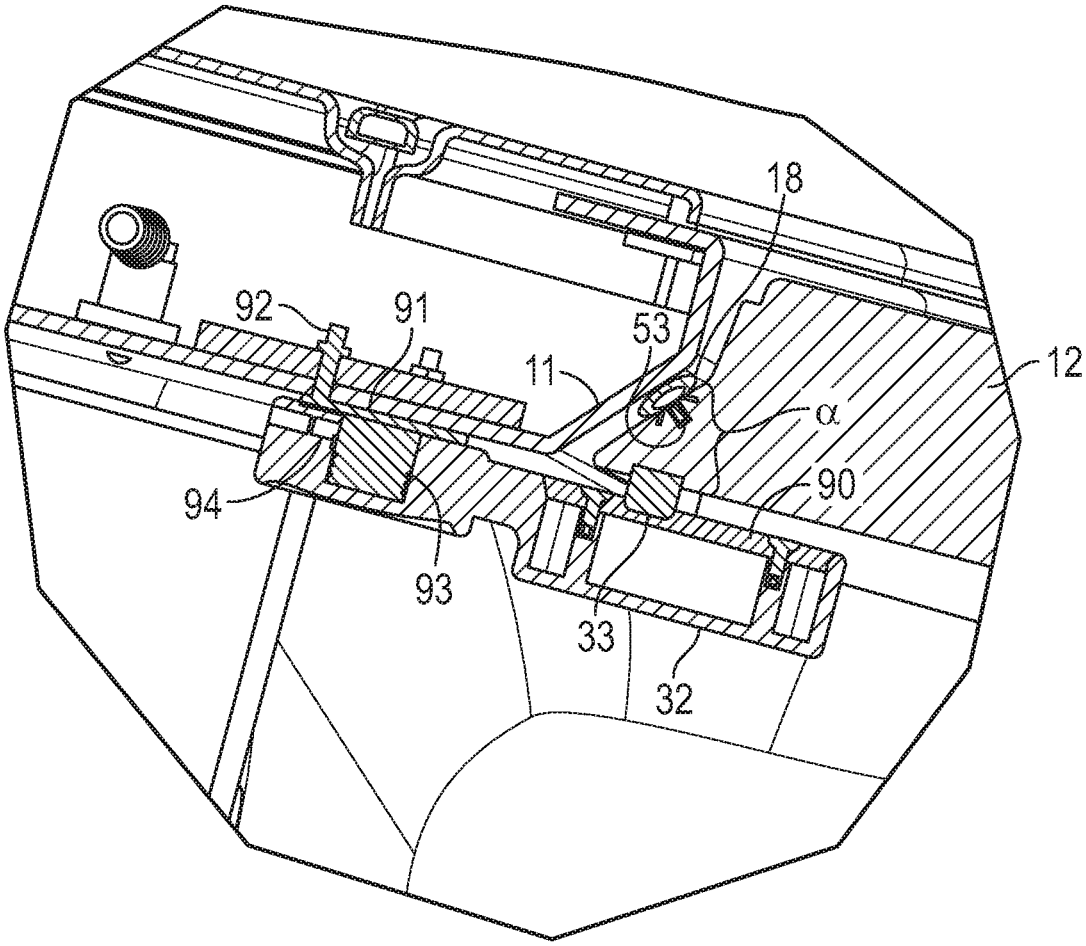
FIG. 9 is a sectional view of a portion of a walk-in bath, according to an embodiment.

FIG. 9 provides a sectional view of a portion of a walk-in bath, according to an embodiment. Handle 32 is engaged with engagement surface 80 (not visible) of strike plate 33 via handle insert 90. Gasket 18 is received in channel 53 of door 12 and forms a seal with sidewall 11. Angle $\alpha$ of door 12 that forms a seal with sidewall 11 is about 43 degrees in this embodiment. Handle 32 comprises base 91 affixed to sidewall 11 via anchor 92. Base 91 comprises threaded portion 93 configured to engage a threaded portion of handle 32. Base 91 may comprise limiter 94, configured to limit a rotation of handle 32 relative to base 91.

Figure 10:
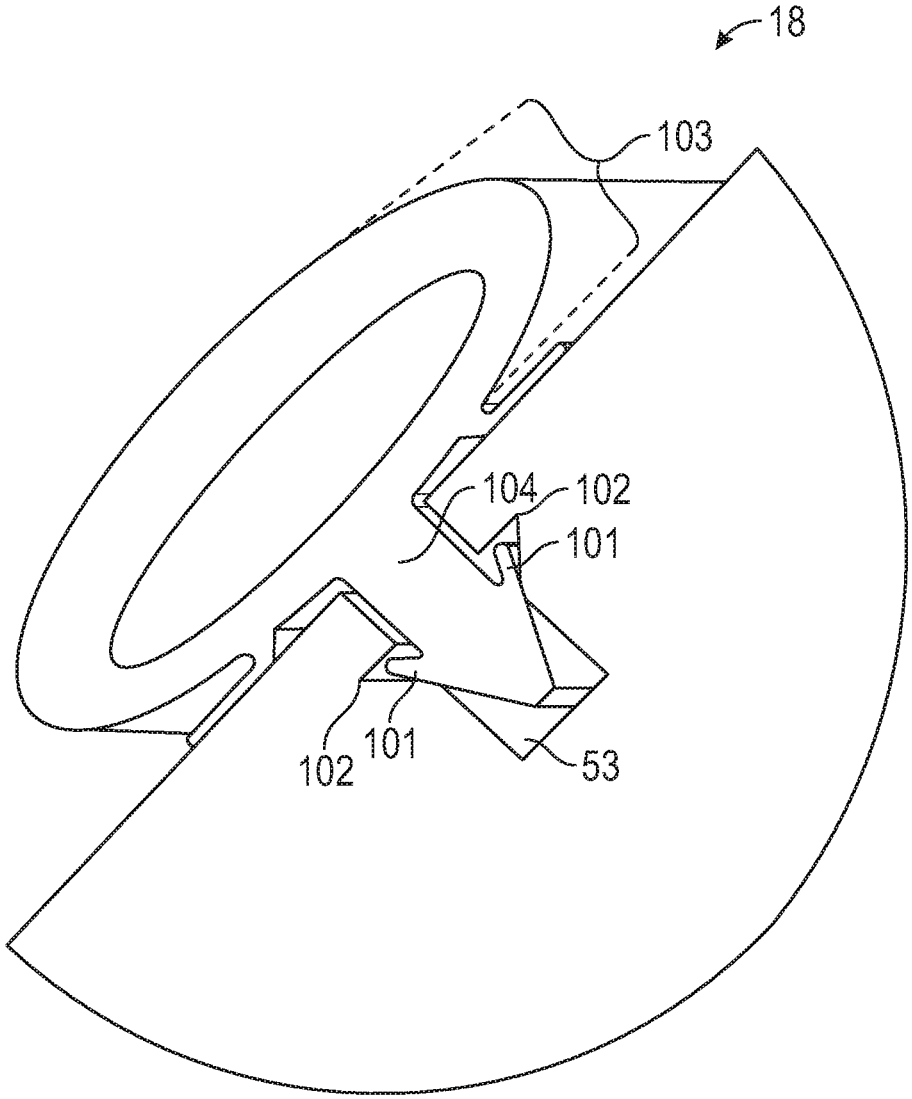
FIG. 10 is a top view of a groove comprising a gasket, according to an embodiment.

FIG. 10 shows a cross-section view of gasket 18 comprising barbs 101 disposed in channel 53. Channel 53 comprises slots 102 configured to receive barbs 101. Gasket 18 comprises oval shaped body section 103 configured to form a seal with a sidewall and anchor section 104 comprising barbs 101. With anchor section 104 disposed in channel 53 and with gasket body 103 positioned outside of channel 53, gasket 18 is considered to be disposed in channel 53.

Figure 11:
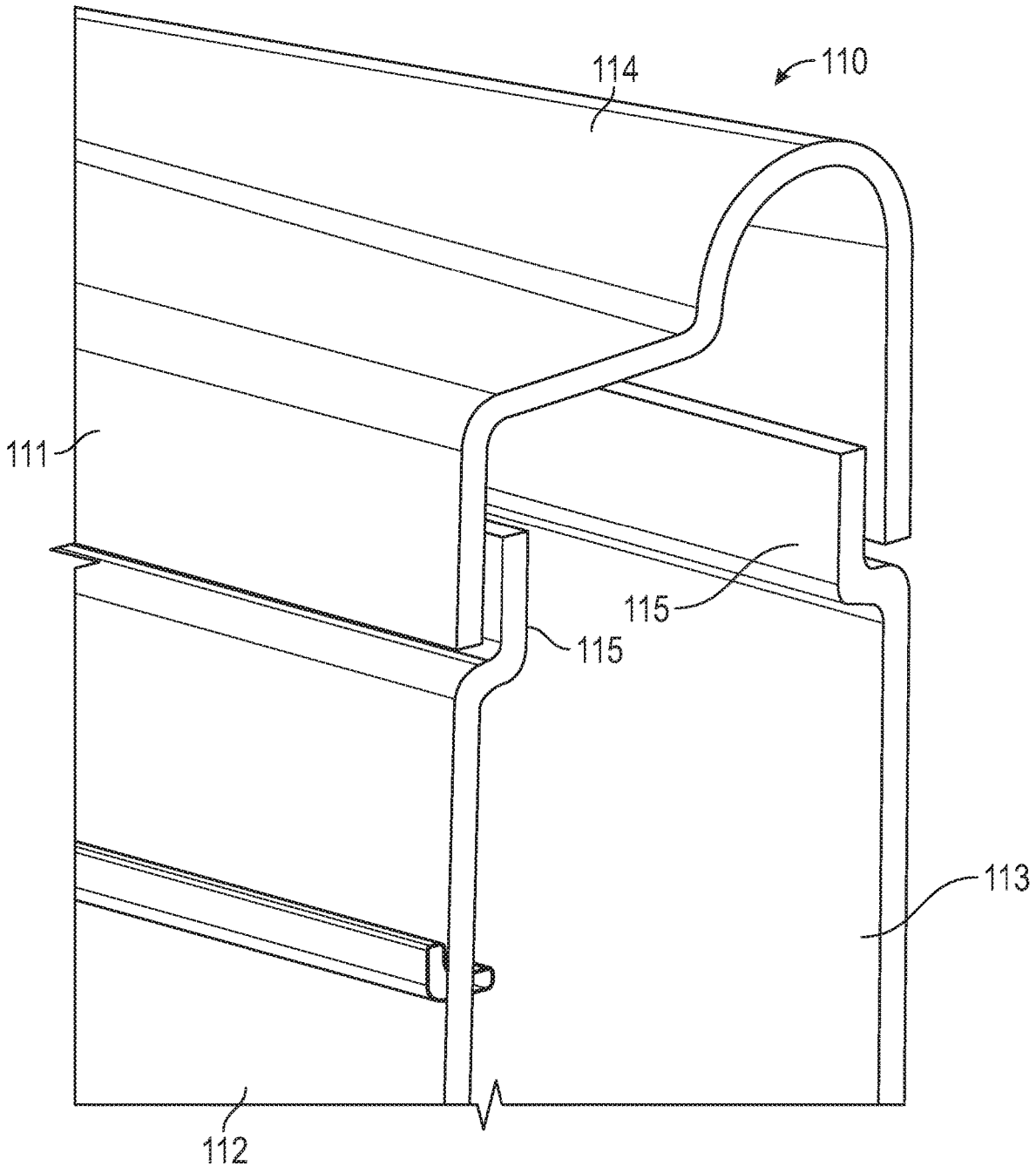
FIG. 11 is a perspective view of a portion of a door in accordance with another embodiment.

FIG. 11 shows another embodiment of a door 110. Door 110 includes cap 111 coupled to first piece 112 and second piece 113. Cap 111 may include fin 114. First piece 112 and second piece 113 may include flanges 115. Flanges 115 are configured to be received by cap 111. Flanges 115 may be configured to deflect when received by cap 111 such that the flanges form a friction fit or snap fit with the cap.

In some embodiments, a walk-in bath may include a sidewall defining a tub configured to contain water for a bather to bathe in. In some embodiments, a tub may include a seat with a cushion for a bather to sit on within the tub. A cushion may be detachable from the seat. In some embodiments, a portion of a sidewall above the seat may be a backrest. In some embodiments, one or more jet nozzles may be coupled to a backrest or a sidewall.

In some embodiments, a walk-in bath may include a frame. A frame may support the sidewall. One or more panels may be coupled to an exterior of the frame. In some embodiments, one or more panels may be detachably coupled to a frame. One or more panels may be omitted during installation of the walk-in bath to allow access to internal components (e.g., drain lines or water supply lines). In some embodiments, the walk-in bath may include a panel coupled to the front of the frame, the front and one of the left side or right side of the frame, the front, left side, and the right side of the frame, or all four sides of the frame. The frame may be coupled to a base. In some embodiments, a base may have a larger footprint than a frame. In other embodiments, a base and frame may have a similar or a same footprint.

In some embodiments, a walk-in bath may include a headrest. A headrest may be detachably coupled to an upper surface of a walk-in bath. A headrest may be part of a ridge that extends around at least a part of the tub. A headrest may be aligned with an upper surface of a ridge such that the headrest and ridge form a continuous surface. The ridge may taper along its length such that the headrest is at the apex of the ridge. At least one end of a ridge may be coplanar with an upper surface of the walk-in bath. A ridge may have a ridge width that is less than an upper surface width. A ridge may extend around about 100%, about 90%, about 80%, about 70%, about 60%, about 50%, about 40%, about 30%, or about 20% of a sidewall.

A sidewall may include an opening for a bather to enter and exit the walk-in bath. An opening may have an asymmetrical shape (e.g., an asymmetrical V-shape). An opening may be defined by a first side edge, a second side edge and a bottom edge. A bottom edge may be a threshold that is close to a bottom surface of the tub. A bottom edge may be generally parallel to a base or a ground surface. A first side edge may be disposed at an angle of about 90°, about 100°, about 110°, or about 120° relative to a bottom edge. A second side edge may be disposed at an angle of about 80°, about 90°, about 100°, about 110°, about 120°, about 130°, about 140°, or about 150° relative to a bottom edge. In one embodiment, a first side edge is disposed at an angle of about 91° relative to a bottom edge and a second side edge is disposed at an angle of about 97° relative to the bottom edge. In some embodiments, a second side edge may be stepped with a lower part of the edge at a first angle relative to the bottom edge (e.g., about 90 degrees to about 95 degrees) followed by a substantially horizontal section and a second upper portion of the second edge at a second angle relative to the bottom edge (e.g., about 90 degrees to about 95 degrees).

In some embodiments, a walk-in bath may include a door configured to move (e.g., rotate or slide) relative to a sidewall or opening between a closed position and an open position. A door may be moveably coupled to a sidewall via a hinge such as a piano hinge. A door may form a watertight seal with a first side edge, a second side edge, and a bottom edge when the door is in the closed position. A door may include an outer surface configured to be aligned (e.g., co-planar) with an outer surface of the walk-in bath when the door is in the closed position. A door may have an asymmetrical shape corresponding to that of an opening defined above. In some embodiments, a door may have an asymmetrical V-shape.

In some embodiments, a door may include a fin. A fin may extend from an upper surface of the door. In some embodiments, a fin can be manually engaged by a bather such that the fin can be used as a handle to open or close the door. A bather may grasp a fin to brace themselves as they move between sitting and standing positions or as the bather enters or exits the tub. In some embodiments, a fin may have a similar cross-sectional shape and/or profile as a ridge. In some embodiments, a fin and ridge may form an uninterrupted surface. A portion of a fin may have a cross-sectional shape defined by an arc segment of a circle. In one embodiment, a cross-sectional fin shape may have a cross-sectional radius of about 0.25 inches, about 0.5 inches, about 0.65 inches, about 0.75 inches, about 1 inch, about 1.25 inches, about 1.5 inches, about 1.75 inches, or about 2 inches. In some embodiments, an outer perimeter of a fin comprises a concave portion configured for a bather to grasp the fin. In one embodiment, an outer perimeter has an outer perimeter radius of about 0.1 inches, about 0.25 inches, about 0.4 inches, about 0.5 inches, about 0.75 inches, about 1 inch, about 1.25 inches, about 1.5 inches, about 1.75 inches, or about 2 inches.

In some embodiments, a fin may extend above an upper surface of a door. A fin may have a maximum height of about 0.5 inches, about 1 inch, about 1.25 inches, about 1.5 inches, about 2 inches, about 2.5 inches, about 3 inches, about 3.5 inches, or about 4 inches. A fin may have a maximum height at a first end of a door. A fin may be flush with an upper surface on a second end of the door. A fin may taper from a maximum height at the first end to a minimum height at the second end. A fin may have a maximum width at a door first end. A fin width may be a minimum width at a door second end. A fin may have a maximum width of about 4 inches, about 3.5 inches, about 3 inches, about 2.5 inches, or about 2 inches. A fin may have a minimum width of about 0.25 inches, about 0.375 inches, about 0.5 inches, about 0.75 inches, about 1 inch, about 1.25 inches, about 1.5 inches, about 1.75 inches, or about 2 inches. A fin may have a nominal width of about 0.5 inches, about 0.75 inches, about 1 inch, about 1.25 inches, about 1.5 inches, about 1.75 inches, or about 2 inches, about 2.25 inches, about 2.5 inches, about 2.75 inches, or about 3 inches. A fin width may be less than the width of the door. At least one side of the fin may be generally parallel with a side of the door.

A door may include an edge surface extending around at least a portion of the door. An edge surface may extend around at least one of the left side, right side, and bottom of the door. An edge surface may be configured to engage an inner surface of a sidewall and/or opening first side edge, second side edge, and/or bottom edge. A channel may be positioned on a door edge surface and the channel may be configured to receive a gasket. At least one of an opening first side edge, second side edge, and/or bottom edge may have an inverse shape to an edge surface to increase the surface area where the door engages the sidewall. An edge may comprise an angled edge surface.

In some embodiments, a door edge surface configured to engage with and form a seal with a sidewall may be angled; that is to say, a seal surface formed by a door and a sidewall may be angled as illustrated in FIG. 5 and FIG. 9. In some embodiments, a door edge surface angle may be from any of about 35°, about 36°, about 37°, about 38°, about 39°, or about 40°, to any of about 41°, about 42°, about 43°, about 44°, about 45°, about 46°, about 47°, about 48°, about 49°, about 50°, about 51°, about 52°, or more. In some embodiments, both a left side door edge and right side door edge comprise an angled surface. In other embodiments, only a left side door edge or a right side door edge comprise an angled surface. In some embodiments, a left side door edge, a right side door edge, and/or a bottom door edge may comprise angled surfaces. A left side door edge, right side door edge, and bottom door edge may comprise same or different angled surfaces.

According to this disclosure, an angled door edge surface is one that differs from a substantially 90° angle between a door edge and a door face. A typical door of a home therefore comprises door edge surfaces that are not angled. Thus, a door edge surface having an angle of greater than or less than about 90° is considered "angled".

In some embodiments, a door channel configured to receive a gasket is disposed in a door angled edge surface. In some embodiments, a door edge surface may comprise both an angled portion and a non-angled portion.

In some embodiments, a door may be a unitary construct. In other embodiments, a door may include a first piece and a second piece. A first piece may be coupled to a second piece with one or more adhesives, welding (e.g., ultrasonic welding), rivets, or threaded connectors. A first piece and second piece may be manufactured by injection molding or gas assist injection molding. Injection molding manufacturing methods may cut down on fabrication time and provide molded-in features configured to secure at least one of a hinge, strike plate, or gasket.

In some embodiments, a first piece may include one or more ribs (e.g., reinforcing ribs). In some embodiments, ribs are evenly and/or symmetrically positioned about a first piece. In other embodiments, ribs are selectively positioned about a first piece to strengthen areas that may be subject to increased stress loads. In some embodiments, a first piece includes a higher concentration of ribs corresponding to the location of a strike plate than other locations. In some embodiments, a first piece includes a higher concentration of ribs corresponding to the location of a hinge that couples a door to a sidewall than other locations.

In some embodiments, a first piece may include one or more protrusions configured to be positioned in corresponding receivers in a second piece. Protrusions and receivers may assist in aligning a first piece and second piece during assembly of the door. Protrusions may include a recess configured to receive a connector (e.g., dowel, rivet, or threaded connector) to couple a first piece to a second piece.

In some embodiments, a second piece may include one or more ribs. A location of at least one rib of a second piece may be to align with a rib on a first piece such that the ribs engage each other and provide a continuous structure through a door body. Ribs on a first piece may interlock with ribs on a second piece. In some embodiments, each rib on a second piece align with a rib on a first piece. In some embodiments, a second piece includes more ribs than a first piece. In some embodiments, a second piece includes less ribs than a first piece.

In some embodiments, a door may include one or more cavities between a first piece, a second piece, and ribs. The cavities may be filled with foam or insulation. In some embodiments, the cavities may comprise a volume of about 50%, about 60%, about 70%, about 80%, or about 90% of a total volume of a door.

In some embodiments, a perimeter of at least one of a first piece and a second piece may be recessed from an adjacent surface such that a groove extends around at least a portion of a door. A groove may have a width of about 0.01 inches, about 0.02 inches, about 0.03 inches, about 0.04 inches, about 0.05 inches, about 0.06 inches, about 0.07 inches, about 0.1 inch, about 0.15 inches, about 0.25 inches, or about 0.5 inches. A groove may have a depth of about 0.01 inches, about 0.02 inches, about 0.03 inches, about 0.04 inches, about 0.05 inches, about 0.06 inches, about 0.07 inches, about 0.1 inch, about 0.15 inches, about 0.25 inches, or about 0.5 inches. A groove may be filled with a color matching adhesive (e.g., colored epoxy). An adhesive may be buffed and polished to match the appearance of a door. A coat of paint (e.g., spray paint) may be applied to the buffed and polished adhesive. A coat of paint on the adhesive may then be buffed and a finish coat (e.g., clear coat) may be applied. A finish coat may then be buffed. In some embodiments, an entire door including the adhesive may be painted to present a uniform appearance.

In some embodiments, a door may include a strike plate configured to engage a handle of the walk-in bath to maintain the door in a closed position. In some embodiments, the strike plate is molded into a door second piece. In other embodiments, a strike plate may be coupled to a second piece via one or more adhesives, welding, rivets, threaded fastener or other mechanical fastener. A strike plate may have an engagement surface such that as the handle moves relative to the strike plate, the door is moved into the fully closed position. At least a portion of an engagement surface may be defined by an arcuate segment having a radius of about 30 mm to about 300 mm. An engagement surface may be defined by a spline shape (e.g., a plurality of arcs connected to each other to form a continuous shape) having radii that vary from about 30 mm to about 300 mm. In some embodiments, an engagement surface may have a convex section and a concave section, with the convex section above the concave section.

In some embodiments, a handle may include an insert configured to engage an engagement surface of a strike plate. An insert may be manufactured from a material that is more durable than other portions of the handle. In some embodiments, an insert may comprise one or more of high density polyethylene (HDPE), aluminum, acetal polyoxymethylene (POM), or stainless steel. An insert may be coupled to a handle via one or more of anchors, welding, adhesive, or rivets. An insert may be detachably coupled to a handle such that the insert is replaceable. A handle may be rotatable about an axis to engage and disengage an engagement surface to allow the door to move between closed and open positions.

In some embodiments, a gasket may be provided to help create a watertight seal between a door and a sidewall (e.g., a tub inset flange on a sidewall) around the perimeter of the opening. An anchor section of a gasket may be received in a channel of a door. In some embodiments, a gasket anchor section may include one or more barbs configured to secure the gasket within the channel. A gasket may be detachably coupled to a door. A gasket may include a body configured to be positioned outside of a channel such that the body engages a sidewall when the door is in the closed position. A gasket having an anchor section disposed in a channel and a gasket body outside the channel is considered to be disposed in the channel. A gasket body may be configured to elastically deform to occupy a space between a sidewall and door to create a watertight seal when the door is in the closed position. A gasket body may be manufactured from a first material and a gasket anchor section may be manufactured from a second material different from the first material. Alternatively, a gasket body and anchor section may comprise same or similar materials. In some embodiments, a gasket body section may be hollow.

In some embodiments, a door channel configured to receive a gasket may comprise a shape configured to receive and mate with a gasket anchor section. In some embodiments, a door channel may comprise one or more slots configured to receive a gasket anchor section. In some embodiments, a door channel may comprise barb-shaped portions configured to receive and mate with barbs of a gasket anchor section.

In some embodiments, a channel may have a reduced width portion compared to an adjacent portion. A channel reduced width portion may enhance the purchase or mating between a gasket anchor section and a door.

In some embodiments, a handle may include a base. In some embodiments, a handle base is fixed to a sidewall via an anchor. In other embodiments, a base is fixed to a sidewall via one or more of an adhesive, welding, or rivet. A base may include a threaded portion configured to engage a threaded portion on the handle. A threaded engagement between a handle and a base may allow the handle to be rotated a first amount (e.g., about 360°) relative to the base to advance toward the sidewall. An insert and/or a gasket may flatten or wear down over time. In some embodiments, a handle may be rotated to an additional amount (e.g., about) 360° relative to the base to advance the handle further toward the sidewall to maintain the seal between the door and the sidewall even when a gasket flattens or an insert wears down. A base may include a recess configured to receive a limiter. A limiter may limit the rotation of the handle relative to the base.

In some embodiments, a door may comprise a cap that may couple to a door first piece and a door second piece. A cap may comprise a fin. A door first piece and/or a door second piece may include a flange configured to be received by the cap. A flange may be configured to deflect as it is received by the cap such that the flange forms a friction fit or snap fit with the cap. A cap may be coupled to a first piece and/or a second piece via one or more adhesives, weld, or mechanical fastener. In some embodiments, a cap may be detachably coupled to a door first piece and/or second piece.

In another embodiment, a door may comprise a first piece and/or a second piece having a flange. A flange may be configured to be received by a gasket. The gasket may be configured to provide a seal between the door and a sidewall. The gasket may be deformable to conform to the size and shape of a space between the flange and the sidewall. The flange may comprise a first portion and a second portion, wherein the first portion may be transverse to the second portion. The second portion may comprise a male connector configured to be received by a gasket female connector. The gasket may be coupled to the flange via one or more adhesives, friction fit, or snap fit.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. The words "inwardly" and "outwardly" refer to directions toward and away from, respectively, the geometric center of the walk-in bath.

The term "adjacent" means "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

All U.S. patent applications, published patent applications and patents referred to herein are hereby incorporated by reference.

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

The invention claimed is:

1. A walk-in bath comprising a sidewall and a door; wherein the door is configured to be in an open position or a closed position, the sidewall and closed door define a tub interior configured to hold bathing water, the door is configured to open towards the tub interior, the door comprises a fin having a concave portion configured to be grasped by a bather, the fin comprises a continuous projection positioned on a top edge of the door between a first end of the door and a second end of the door, the fin is tapered, having a maximum height and a maximum width at the door first end, and a minimum height and a minimum width at the door second end, and the fin comprises a portion having a cross-sectional shape defined by an arc segment of a circle.

2. The walk-in bath of claim 1, wherein the door comprises a gasket configured to enhance a seal between the door and the sidewall.

3. The walk-in bath of claim 2, wherein the gasket comprises a gasket body configured to deform and to engage the sidewall in the door closed position to form a seal.

4. The walk-in bath of claim 2, wherein the door comprises a channel having a gasket disposed in the channel.

5. The walk-in bath of claim 4, wherein the gasket comprises an anchor section and a gasket body, and wherein the gasket anchor section is disposed in the channel.

6. The walk-in bath of claim 5, wherein the gasket anchor section comprises one or more barbs configured to engage the channel.

7. The walk-in bath of claim 6, wherein the channel comprises one or more slots configured to receive and mate with the barbs.

8. The walk-in bath of claim 1, wherein the door comprises an angled edge surface.

9. The walk-in bath of claim 1, wherein the door comprises a left side angled edge surface, a right side angled edge surface, and a bottom angled edge surface.

10. The walk-in bath of claim 1, wherein the door comprises a left side angled edge surface, a right side angled edge surface, and a bottom angled edge surface, and wherein the angled edge surfaces comprise an angle of from 39 degrees to 49 degrees.

11. The walk-in bath of claim 1, wherein the door comprises a channel having a gasket disposed therein, and wherein the channel is disposed in a door angled edge surface.

12. The walk-in bath of claim 1, comprising a ridge on at least a portion of an upper surface of the sidewall, wherein the fin forms a continuous surface with the ridge when the door is in the closed position.

13. The walk-in bath of claim 1, wherein an outer perimeter of the fin comprises the concave portion.

14. The walk-in bath of claim 10, wherein the angled edge surfaces comprise an angle of from 40 degrees to 46 degrees.

15. The walk-in bath of claim 10, wherein the angled edge surfaces comprise an angle of from 41 degrees to 45 degrees.

16. The walk-in bath of claim 1, wherein the fin and the door are a unitary construct.

17. The walk-in bath of claim 1, wherein the fin is detachably coupled to the door.

18. The walk-in bath of claim 1, wherein at least one side of the fin is parallel to the door.

19. The walk-in bath of claim 1, comprising a handle coupled to the sidewall, the handle configured to engage a strike plate and to maintain the door in the closed position.

20. The walk-in bath of claim 19, wherein the strike plate comprises a surface configured to engage the handle, and wherein the strike plate surface comprises a convex section and a concave section.

* * * * *